United States Patent [19]

Shinagawa

[11] Patent Number: 4,658,553

[45] Date of Patent: Apr. 21, 1987

[54] MULTI-WINDOWPANE STRUCTURE FOR USE IN A TEMPERATURE CONTROLLED ENVIRONMENT

[75] Inventor: Katsumi Shinagawa, Gunma, Japan

[73] Assignee: Sanden Corporation, Gunma, Japan

[21] Appl. No.: 758,970

[22] Filed: Jul. 25, 1985

[30] Foreign Application Priority Data

Jul. 25, 1984 [JP] Japan ..... 59-111600[U]
Sep. 18, 1984 [JP] Japan ..... 59-141477[U]

[51] Int. Cl.[4] ..... E06B 3/24; E06B 7/12

[52] U.S. Cl. ..... 52/172; 52/304; 52/398; 52/788; 428/34

[58] Field of Search ..... 52/172, 304, 398, 788; 428/34

[56] References Cited

U.S. PATENT DOCUMENTS 3,803,784 4/1974 Becker ..... 52/172 X
4,074,480 2/1978 Burton ..... 52/172 X
4,479,988 10/1984 Dawson ..... 52/172 X
4,551,364 11/1985 Davies ..... 52/172 X
4,564,540 1/1986 Davies et al. ..... 52/172

*Primary Examiner*—J. Karl Bell
*Attorney, Agent, or Firm*—Banner, Birch, McKie & Beckett

[57] ABSTRACT

A multi-windowpane structure for use in a temperature controlled environment such as a refrigerator or freezer with a display chamber. The window comprises two parallel glass panes which are separated from one another by a spacer disposed along their edges. The spacer is formed of transparent resinous material and contains a drying element. Therefore, high visibility of the merchandise on display is achieved. Since the spacer is formed of a resinous material, its rate of heat transfer is very low. Thus, the formation of condensation along the inner surfaces of the glass panes is greatly reduced.

8 Claims, 9 Drawing Figures

MULTI-WINDOWPANE STRUCTURE FOR USE IN A TEMPERATURE CONTROLLED ENVIRONMENT

BACKGROUND OF THE INVENTION

This invention generally relates to the field of temperature controlled environments, and more particularly, is directed to a multi-windowpane structure for use in a display case.

Multi-windowpane structures are well known in the prior art. For example, in conventional temperature controlled display cases, such as those used to display frozen or perishable foodstuff, the transparent portion of the case is usually made of an insulative multi-windowpane structure which is interposed between a colder region and a warmer region. In a refrigerated display case, the purpose of the multi-windowpane structure is to insulate the colder inside region from the warmer outside region in order to conserve the amount of energy required to operate the refrigeration system and to prevent the formation of condensation on the window structure.

As shown in FIGS. 1 and 2, a multi-windowpane structure, which is generally indicated by reference No. 1, usually comprises two parallel glass panes 2 and 3 which are separated from one another by spacers 4 disposed along their respective edges. The gap between each pane 2, 3 and the outer side of spacer 4 are filled by seal element 5 in order to seal off a space A' defined by panes 2, 3 and spacers 4. Spacers 4 also contain a drying material or agent 6, such as silica gel, for preventing condensation from forming on the inner surface of panes 2, 3.

In the multi-windowpane structure shown in FIGS. 1 and 2, spacers 4 are usually formed of aluminum alloy or steel. However, when such a structure is used as the display window in a display case with at least three viewing sides, each corner or edge of the display window is obscured by spacers 4. Therefore, visibility through the display window is diminished.

SUMMARY OF THE INVENTION

It is, therefore, a primary object of the present invention to provide an improved multi-windowpane structure which has good viewing characteristics from all viewing directions.

It is another object of the present invention to provide a multi-windowpane structure which is not susceptible to the formation of condensation on the windowpanes.

It is a further object of the present invention to provide a multi-windowpane structure which can be readily assembled by simple fastening means.

It is a still further object of the present invention to provide a multi-windowpane structure for use in a display case which affords good visibility of the merchandise maintained in the display case.

These and other objects of the present invention are achieved by a multi-windowpane structure comprising two glass panes held in spaced parallel position by a spacer disposed therebetween along the edges of the glass panes. A seal element is disposed outside of the spacer to seal off the space between the glass panes. The spacer contains a drying material or agent which prevents the formation of condensation on the inner surfaces of the glass panes. At least a portion of the spacer is formed of a transparent resinous material.

These and other objects of the present invention will be understood from the following detailed description of the preferred embodiment with reference to the drawings.

DETAILED DESCRIPTION

Figure 1:
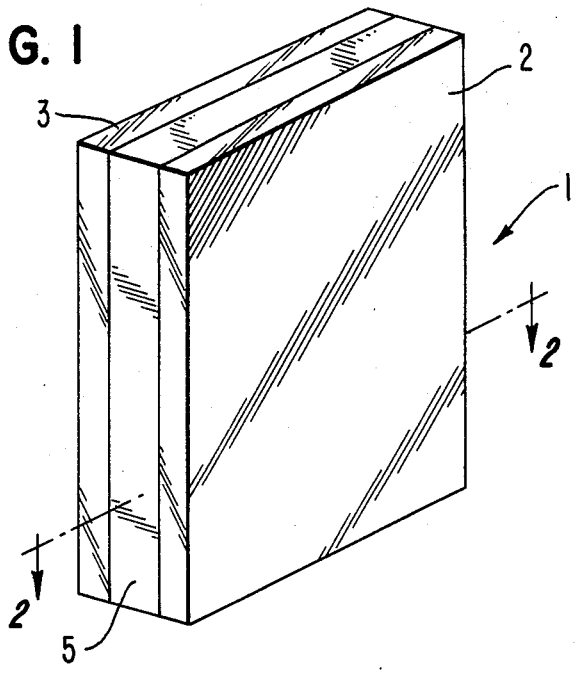
FIG. 1 is a perspective view of a multi-windowpane structure known in the prior art.
Figure 2:
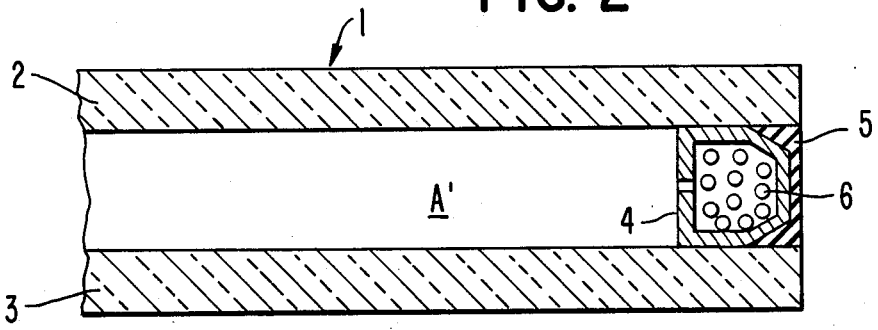
FIG. 2 is a horizontal cross-sectional view of the multi-windowpane structure shown in FIG. 1 taken along line 2—2.
Figure 3:
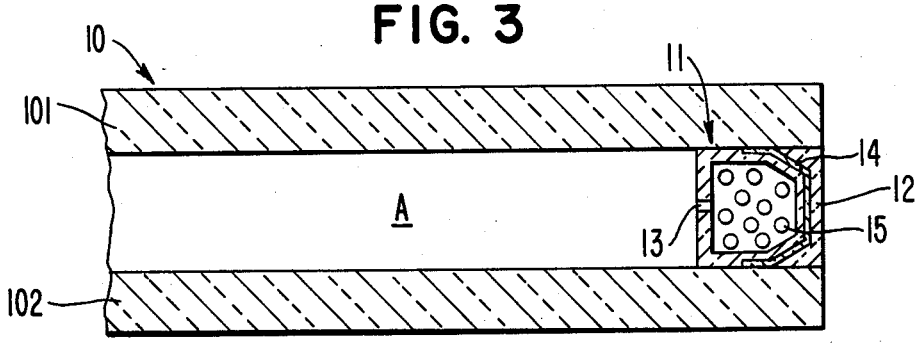
FIG. 3 is a cross-sectional view of a multi-windowpane structure in accordance with one embodiment of the present invention.

Referring to FIG. 3, a multi-windowpane structure in accordance with one embodiment of the present invention is shown. The structure, which is generally indicated by reference No. 10, comprises two parallel glass panels 101 and 102 which are separated from one another and a spacer 11. Spacer 11 is disposed along the edges of panes 101 and 102 to maintain a space A therebetween. A seal element 12 is disposed on the outside of spacer 11 and fully fills the gap defined between panes 101 and 102. Thus, space A is sealed off by seal element 12.

Spacer 11 is formed of a transparent resinous material and is hexagonally shaped in cross-section with a vertically extending gap 13 at its inner side surface. The outer surface of spacer 11, which is adjacent seal element 12, is covered by a reinforcement element 14 for reinforcing spacer 11. Element 14 also constructed to prevent the penetration of moisture from the outside air into spacer A between panes 101 and 102.

A drying element or agent 15, for example silica gel, is disposed within the interior of spacer 11. Because the air in space A is permitted to circulate within the interior of spacer 11 through gap 13, the air in space A is maintained dry by drying element 15. Thus, the formation of condensation on the inner surfaces of glass panels 101 and 102 is prevented. Furthermore, the heat transfer rate of spacer 11, which is made of a resinous material, is lower than the heat transfer rate of a spacer made of metal. Thus, the air in space A is not influenced by changes in outside temperature.

Figure 6:
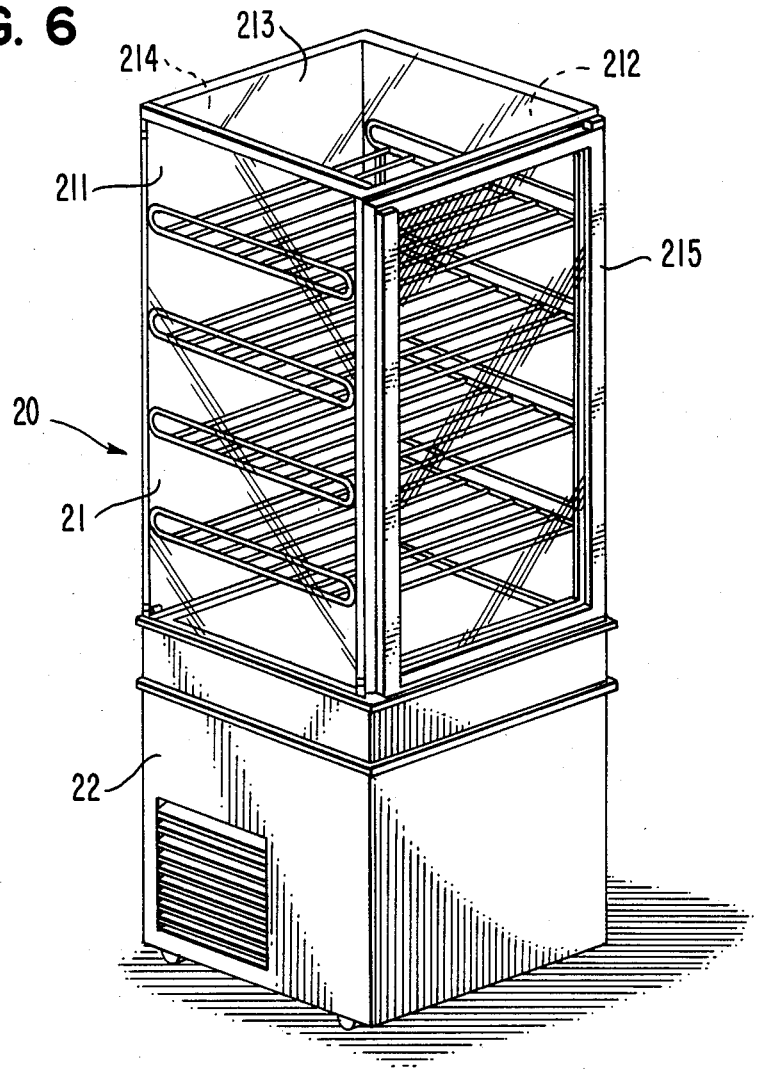
FIG. 6 is a refrigerated display case using the multi-windowpane structure shown in FIG. 3.

With reference to FIG. 6, a refrigerated display case is shown incorporating the multi-windowpane structure of the present invention. The display case is generally indicated by reference No. 20 and includes a mechanical chamber 22, within which a refrigeration unit is disposed, and a merchandise display chamber 21 which is placed above mechanical chamber 22 and is maintained cool by the refrigerator unit. Display chamber 21 is defined by side panels 211, 212, upper panel 213, front panel 214 and rear door panel 215. Each panel is a multi-windowpane structure in accordance with the embodiment of the invention shown in FIG. 3. As can be seen in FIG. 6, each outer corner or edge of the panels is covered by only reinforcing element 14 attached on the outer surface of spacer 11. The panels may be connected together in the manner disclosed in applicant's co-pending and commonly assigned application Ser. No. 750,268 filed July 1, 1985. Said application is herein incorporated by reference.

Figure 4:
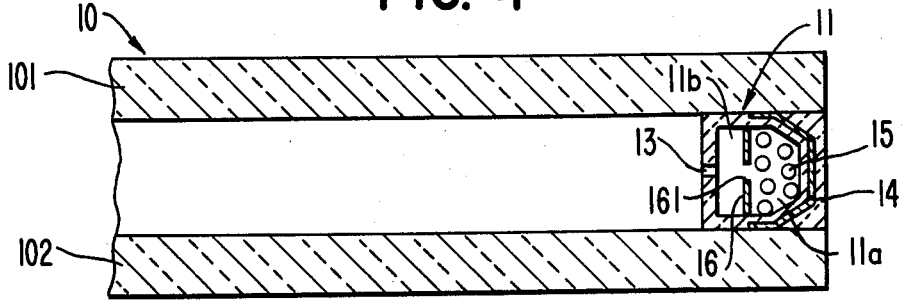
FIGS. 4 and 5 are cross-sectional views of multi-windowpane structures in accordance with another embodiment of the present invention.

In the embodiment of the multi-windowpane structure shown in FIG. 3, spacer 11 is formed of transparents material with drying element 15 contained within its interior. Thus, drying element 15 may hinder the visibility of merchandise in a display case. A solution to this problem is the embodiment of the present invention shown in FIG. 4. In this embodiment, a divider plate 16 is disposed within the interior of spacer 11 to divide spacer 11 into two chambers 11*a*, 11*b*. Divider plate 16 has a gap 161 which enables the circulation of air between chambers 11*a* and 11*b*. Drying element 15 is disposed within outer chamber 11*a* which is defined by divider plate 16 and the outside portion of spacer 11 which is covered by reinforcing element 14. Therefore, a portion of spacer 11 is not blocked by drying element 15. Thus, when windowpanels of this construction are used in a display case, visibility of the displayed merchandise is improved.

Figure 5:
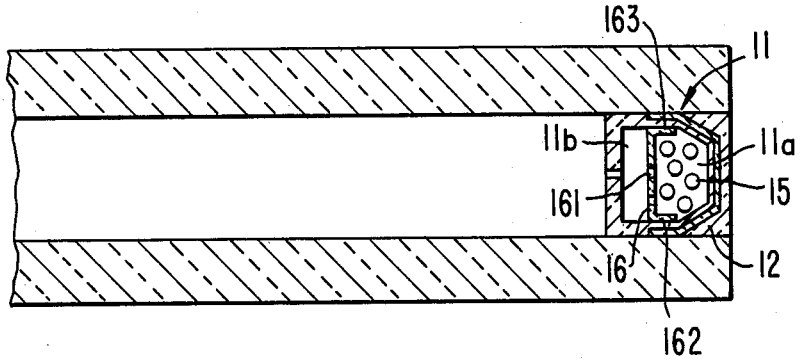

Another embodiment of the multi-windowpane structure of the present invention is shown in FIG. 5. In this embodiment, divider plate 16 of spacer 11 has flange portions 162 and 163. These flange portions are formed so that they provide a compression fit for divider plate 16 within spacer 11. Accordingly, assembly of divider plate 16 within spacer 11 can be achieved rather easily.

Figure 8:
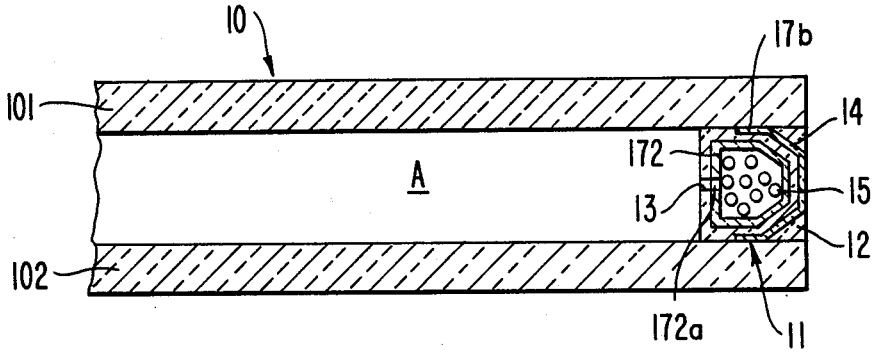
FIG. 8 is a horizontal cross-sectional view of a multi-windowpane structure using the connecting element shown in FIG. 7.
Figure 9:
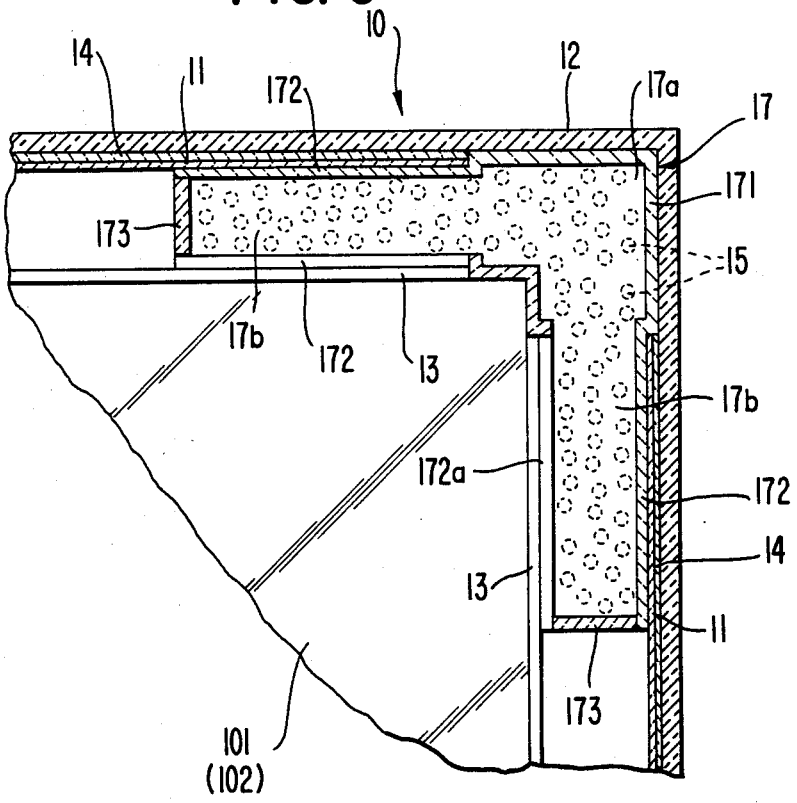
FIG. 9 is a vertical cross-sectional view of a multi-windowpane structure also using the connecting element shown in FIG. 7.
Figure 7:
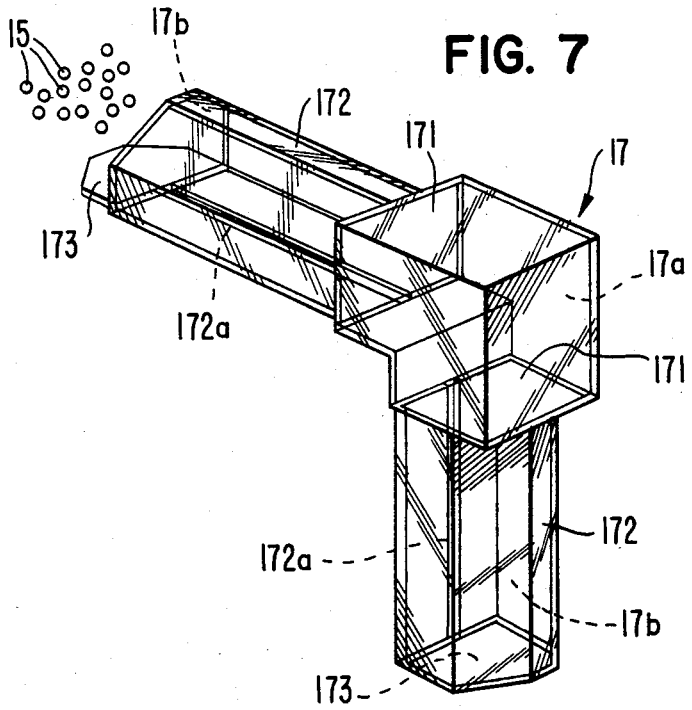
FIG. 7 is an assembly view of the connecting element used in a multi-windowpane structure in accordance with another embodiment of the present invention.

With reference to FIGS. 7–9, another embodiment of the multi-windowpane structure of the present invention is shown. As shown in FIGS. 7 and 8, window structure 10 is provided with a connecting element 17 which is formed of a transparent material. Element 17 includes receiving sections 171 which receive connecting sections 172. Connecting element 17 is L-shaped in construction and has a hollow portion 17*a* which receives drying element 15. Connecting sections 172 project from the ends of receiving section 171 to extend within the interior of each spacer 11. The interior of connecting sections 172 is a hollow space 17*b* which connects to hollow portion 17*a* of receiving section 171 and also connects to space A of window 10 through gap 172*a* formed on an end surface thereof facing gap 13 of spacer 11. Each end of connecting sections 172 are open to facilitate loading of drying element 15. The ends are then covered by plate 173. When windowpanels of this construction are used in a display case, visibility of the displayed merchandise is also improved. Moreover, spacer 11 is formed of resinous material which has a low rate of heat transfer. Therefore, outside changes in temperature will not cause condensation to form on the interior of the windowpanes.

This invention has been described in detail in connection with preferred embodiments. These embodiments, however, are merely for example only and this invention is not restricted thereto. It will be easily undestood by hose skilled in the art that other variations and modifications can be easily made within the scope of this invention, as defined by the appended claims.

I claim:

1. In a multi-windowpane structure for use in a temperature controlled environment, said structure including a pair of glass panes maintained in spaced parallel position by a spacer disposed therebetween along the edges of said glass panes and a seal element disposed on the outside of said spacer to seal off the space between said panes, an improvement comprising said spacer being formed of transparent resinous material, wherein there is substantial visibility through said spacer.

2. The multi-windowpane structure of claim 1 wherein said spacer includes a reinforcement element.

3. The multi-windowpane structure of claim 1 wherein said spacer has a vertically extended gap at an inner surface thereof for receiving a drying element into a space within the interior of said spacer, said drying agent serving to prevent the formation of condensation between said glass panes.

4. The multi-windowpane structure of claim 3 wherein the interior of said spacer is divided into inner and outer chambers by a plate, said plate having a hole connecting said two chambers, said drying element being disposed in said outer chamber of said spacer.

5. The multi-windowpane structure of claim 4 wherein said plate has flange portions at its end portions in pressure contact with the inner surface of said spacer to maintain said plate in a fixed position.

6. The multi-windowpane structure of claim 1 further comprising a connecting element disposed in each corner of said windowpane, a drying member being disposed in the interior of each of said connecting element.

7. The multi-windowpane structure of claim 6 wherein said connecting elements comprise a receiving section with a hollow space to receive said drying element and connecting portions projecting from each end of said receiving section for extending into the interior of said spacer.

8. In a multi-windowpane structure for use in a temperature controlled environment, said structure including a pair of glass panes maintained in spaced parallel position by a spacer disposed therebetween along the edges of said glass panes and a seal element disposed on the outside of said spacer to seal off the space between said panes, an improvement comprising said spacer being formed of transparent resinous material and a reinforcement element, said reinforcement element providing mechanical strength to said spacer.

* * * * *